United States Patent [19]

Bald et al.

[11] Patent Number: 4,563,888

[45] Date of Patent: Jan. 14, 1986

[54] SIX-HIGH ROLL STAND WITH BRACED AND REMOVABLE WORKING ROLLS

[75] Inventors: Wilfried Bald, Hilchenbach; Hans Römmen, Dormagen; Erich Stoy, Ratingen, all of Fed. Rep. of Germany

[73] Assignee: SMS Schloemann-Siemag AG, Dusseldorf, Fed. Rep. of Germany

[21] Appl. No.: 657,415

[22] Filed: Oct. 3, 1984

[30] Foreign Application Priority Data

Oct. 3, 1983 [DE] Fed. Rep. of Germany ..... 3335857

[51] Int. Cl.[4] ..... B21B 29/00

[52] U.S. Cl. ..... 72/243; 72/245

[58] Field of Search ..... 72/241, 243, 245

[56] References Cited

U.S. PATENT DOCUMENTS 3,523,439 8/1970 Leifeld et al. ..... 72/241
3,695,082 10/1972 Leifeld et al. ..... 72/243
4,369,646 1/1983 Kajiwera ..... 72/243

FOREIGN PATENT DOCUMENTS 599865 3/1978 U.S.S.R. ..... 72/245

OTHER PUBLICATIONS

German-Language Article Excerpted from Publication, "Herstellung von Kaltgewalztem Band", pp. 309-314, (1970).

*Primary Examiner*—Lowell A. Larson

*Assistant Examiner*—Jorji M. Griffin

*Attorney, Agent, or Firm*—Karl F. Ross; Herbert Dubno

[57] ABSTRACT

A roll stand has a frame having two sides spaced apart transversely of a workpiece travel direction and formed with throughgoing windows and a pair of vertically spaced traverses extending between the frame sides. Two outer backup rolls centered on parallel axes transverse to the direction having journal blocks vertically displaceable and guided in the windows of the frame sides. Upper and lower guide elements vertically displaceable in the windows between the outer-roll blocks carry the journal blocks of two inner backup rolls. Pairs of positioning actuators in the windows vertically between the inner-roll blocks carry supports which carry second upper and lower guide elements vertically displaceable on the supports. The positioning actuators are expansible and contractile to displace the second guide elements in the direction. Two working rolls between and parallel to the other roll axes each have two journal blocks fitted to and axially slidable in the second guide elements. An insert carried in the traverses carries rows of bracing rollers which extend axially along the working rolls between same and the traverses. The insert, bracing rollers, and upstream positioning actuators form an integral bracing unit and at least one of the windows is shaped such that the bracing unit can be withdrawn axially through the frame side. Rows of bracing actuators braced in the direction between the rollers and the traverses can press the rollers opposite to the direction against the working rolls.

13 Claims, 5 Drawing Figures

SIX-HIGH ROLL STAND WITH BRACED AND REMOVABLE WORKING ROLLS

FIELD OF THE INVENTION

The present invention relates to a six-high roll stand. More particularly this invention concerns such a roll stand having working rolls that are braced opposite to the workpiece-travel direction.

BACKGROUND OF THE INVENTION

A standard six-high rolling stand of the type used for rolling strip steel has a pair of vertically spaced nip-defining working rolls of relatively small diameter. Respective upper and lower inner backup rolls of larger diameter bear respectively down and up toward the nip on the respective working rolls, and respective upper and lower outer backup rolls of still larger diameter bear toward the nip on the respective inner backup rolls. All the rolls are carried on journal blocks and those of the working rolls and maybe of the inner backup rolls also, are axially slidably mounted in guide elements that are vertically displaceable in the frame, the blocks of the outer backup rolls normally being carried directly on the edges of the windows of the frame. In addition the roll axes are normally all parallel and coplanar, perpendicular to the workpiece travel direction.

In copending patent application Ser. No. 352,520 filed Feb. 26, 1982 a rolling stand of the above-described type is disclosed, but wherein the inner backup rolls are axially displaceable in the guide elements. Vertically effective actuators can exert a force at least generally parallel to the planes between each journal block and the frame to bend the inner backup rolls and this force can be displaced axially relative to the journal blocks.

In order to use the smallest possible diameter of working roll, so that maximum pressure can be brought to bear on a particularly hard, thin, or wide piece of strip, it is furthermore known to laterally brace these working rolls. This is done as described in pages 309–314 of *Herstellung von kaltgewalztem Band* (Verlag Stahleisen, Dusseldorf; 1970) by providing lateral bracing or backup rolls bearing against the downstream side of the working rolls. In this type of setup the working rolls are normally centered on axes slightly downstream relative to the workpiece travel direction from the plane of the backup-roll axes. The pressure exerted in the upstream direction opposite the workpiece travel direction can be varied over the length of the working rolls to keep them from bowing to a shape concave upstream.

In fact the standard roll stand can operate with working rolls whose diameter varies at least about 50 mm, as this much change in size occurs normally since a working roll is periodically turned down a little to eliminate worn spots and return it to perfect cylindrical shape. Nonetheless, accommodating working rolls that do not lie within this range requires a substantial rebuilding of the stand. In fact such a changeover can take two entire shifts, resulting in a substantial loss of production.

Moreover, it can be necessary, depending on the type of hot- or cold-rolling being done, to operate a single stand with, for instance, only two 900 mm long and 900 mm-diameter rolls. For another application four-high operation with 420 mm-diameter working rolls can be needed, or six-high operation with working rolls from 140 mm to 165 mm. With lateral bracing the working-roll diameter can sink to 52 mm to 57 mm. Converting the stand for such wide variation in size of working roll remains a very complex and time-consuming task. Even so-called convertible stands require major reassembly to accommodate such a wide range of sizes, which are accompanied with the smallest working rolls that must be laterally braced by a downstream shift of the position of the working-roll axes from the plane of the backup-roll axes, so that the changeover is very complex.

OBJECTS OF THE INVENTION

It is therefore an object of the present invention to provide an improved six-high roll stand.

Another object is the provision of such a six-high roll stand which overcomes the above-given disadvantages, that is which can accommodate a wide range of different working-roll diameters without complicated changeover procedures.

SUMMARY OF THE INVENTION

A roll stand according to the invention has a frame having a pair of sides spaced apart transversely of a workpiece travel direction and formed with respective throughgoing windows aligned transversely of the direction and a pair of vertically spaced traverses extending horizontally perpendicular to the direction between the frame sides. Two outer backup rolls centered on parallel axes transverse to the direction are spaced vertically apart and each have two journal blocks vertically displaceable and guided in the windows of the respective frame sides. Respective upper and lower guide elements limitedly vertically displaceable in the windows between the outer-roll journal blocks carry the journal blocks of two inner backup rolls centered on parallel axes between and coplanar with the outer-roll axes. Respective pairs of positioning actuators in the windows vertically between the respective inner-roll blocks have actuators which confront each other in the direction and are oppositely braced in the direction against the respective frame side. Respective supports carried on and between the actuators of each pair themselves carry respective upper and lower guide elements limitedly vertically displaceable on the supports. The positioning actuators are expansible and contractile to displace the guide elements in the direction. Two working rolls centered on parallel axes between and parallel to the other roll axes each have two journal blocks fitted to and axially slidable in the respective journal blocks. Thus the positioning actuators can position the working rolls in the direction. An insert is carried in the traverses axially between and secured to the positioning actuators upstream of the roll-axis plane. Respective rows of bracing rollers are carried on the insert and extend axially along the working rolls between same and the traverses. The insert, bracing rollers, and upstream positioning actuators form an integral bracing unit and at least one of the windows is shaped such that the bracing unit can be withdrawn axially through the respective frame side. Respective rows of bracing actuators braced in the direction between the rollers and the traverses can displace the rollers through at least 50 mm in the direction and press the rollers opposite to the direction against the respective working rolls. Normally the inner backup rolls are axially displaceable with the respective journal blocks in the frame.

Thus it is possible to pull out this insert and to change the working rolls with the bracing unit in the time normally need to make a simple exchange of working rolls. The changeover time for working rolls of substantially different size is therefore very short. Furthermore it is possible to leave out the rollers altogether and merely replace the downstream positioning actuators and insert when large-diameter working rolls needing no bracing are employed.

According to another feature of this invention the bracing actuators are carried permanently in the respective traverses and each have upstream ends. The rollers each have force-transmitting links having downstream ends complementary to the respective upstream ends and having axially extending interengaging formations that couple the bracing actuators in the direction to the respective links and that permit the links to slide axially with the insert off the bracing actuators. The upstream ends of the bracing actuators are circumferentially grooved and the downstream ends of the links are each formed with a complementary T-section groove open parallel to the axes.

Thus sliding out the unit uncouples the links from the bracing actuators, eliminating the necessity of undoing all the normally hydraulic connections to these actuators.

In addition the system of this invention has respective pairs of outer actuators flanking the rows of bracing actuators, respective link arms extending upstream through the insert toward the working rolls and having upstream ends, and respective force-transmitting bracing rolls rotatable about and centered on axes parallel to and downstream of the respective working rolls and journaled in the outer ends of the link arms. Thus the outer actuators, link arms, and bracing rolls also form an integral but not unitary part of the bracing unit.

The positioning actuators are of the type described in commonly owned and jointly filed application Ser. No. 657,402 filed 10/3/84, to which reference should be made for more details.

In this arrangement the outer actuators are also carried permanently in the respective traverses and each have upstream ends like those of the bracing actuators. The link arms have downstream ends complementary to the respective upstream ends and having axially extending interengaging formations that couple the outer actuators in the direction to the respective link arms and that permit the link arms to slide axially with the insert off the outer actuators.

The link arms and upstream positioning actuators are formed with interengaging guides extending generally in the direction and defining the paths of movement of the respective bracing rolls. In addition, a pair of workpiece guide flaps pivoted on the insert about respective axes spaced downstream from the plane and defining a workpiece passage is guided by similar formations on the link arms, to control the positions of the respective flaps. The paths of these guides are determined by working-roll diameter.

According to another feature of this invention, a drive can be provided at one of the frame sides connected to the backup rolls for rotating same about the respective axes.

When the bracing rollers are used according to the invention the axes of the working rolls are downstream of the plane of the outer- and inner-roll axes.

In addition according to this invention the inner-roll journal blocks and the respective guide elements are formed with interengaging axially extending slide formations. The inner-roll journal blocks and their formations are symmetrical about horizontal planes and the respective inner-roll axes are offset therefrom. This makes reversal of these blocks possible for different positioning of these rolls.

DESCRIPTION OF THE DRAWING

The above and other features and advantages will become more readily apparent from the following, reference being made to the accompanying drawing in which.

SPECIFIC DESCRIPTION

Figure 1:
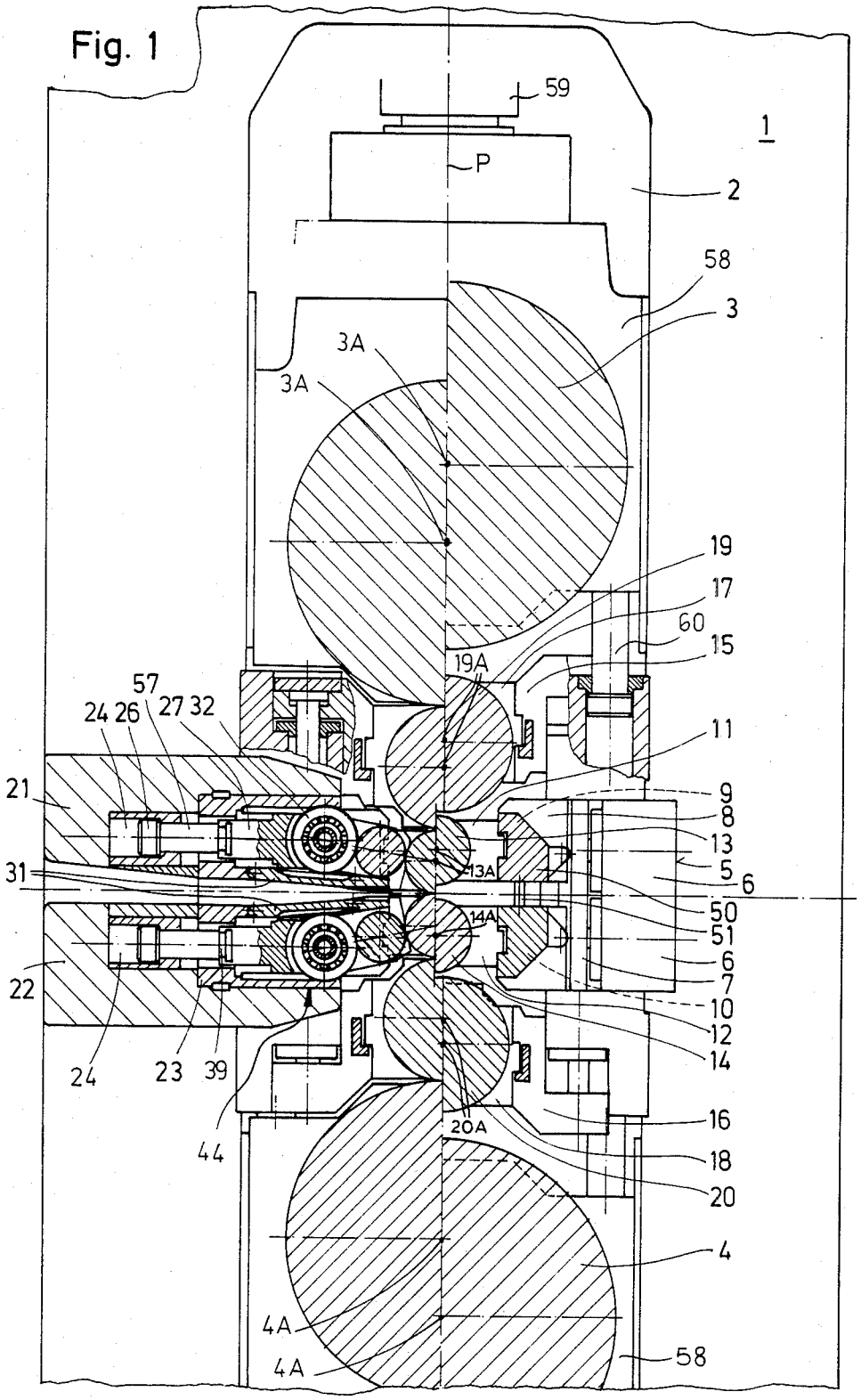
FIG. 1 is a vertical section through a roll stand according to this invention with the stand equipped with small working rolls, open on the right and closed on the left, and with the working-roll bracing unit advanced.
Figure 3:
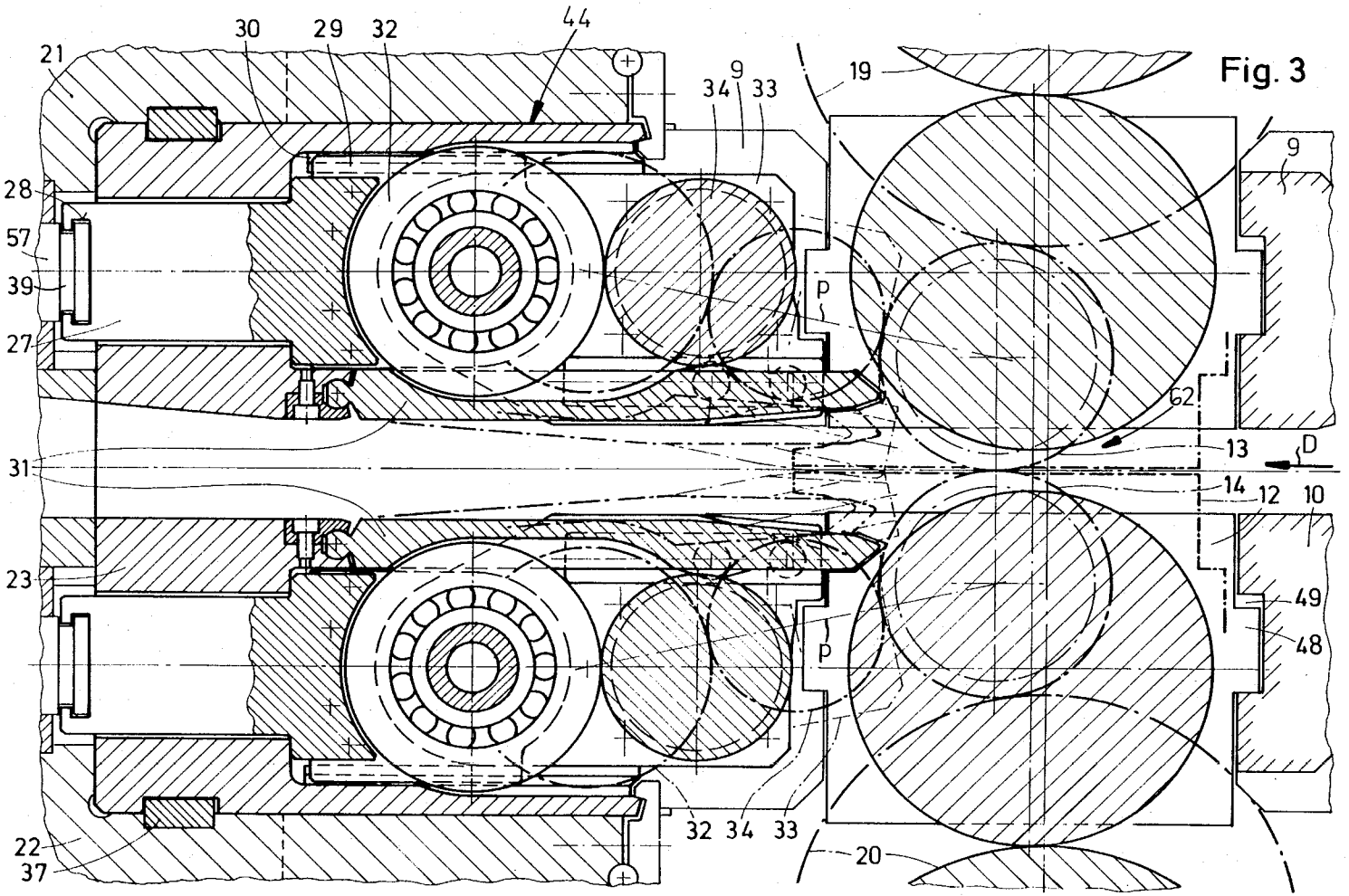
FIG. 3 is a large-scale view of a detail of FIG. 2.
Figure 4:
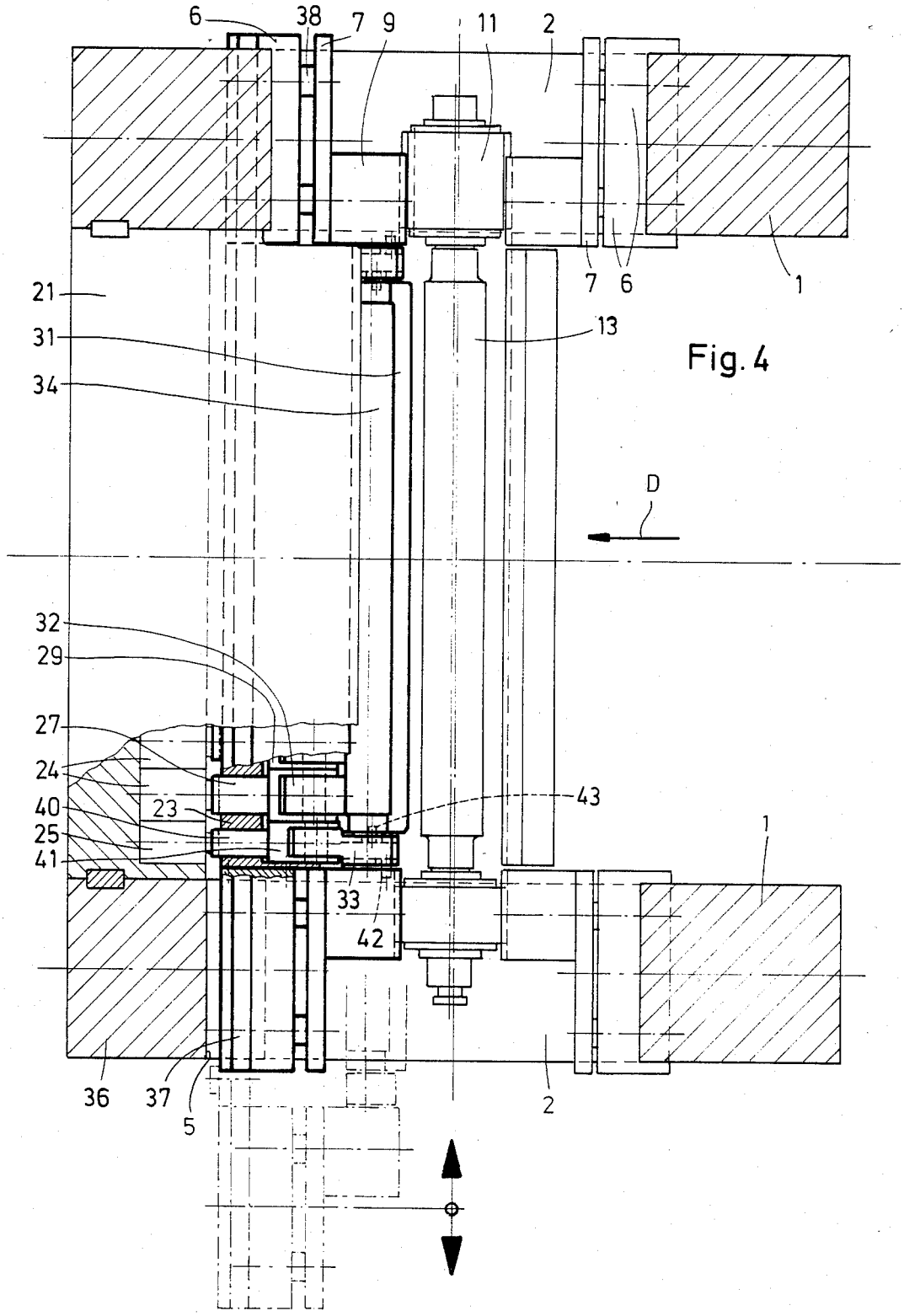
FIG. 4 is a horizontal section through the stand of FIG. 1.

As seen in FIGS. 1 and 4 a roll stand has a frame 1 formed with two windows 2 (only one visible) carrying the vertically slidable journal blocks 58 for upper and lower large-diameter outer backup rolls 3 and 4 centered on respective parallel and horizontal axes 3A and 4A and vertically displaceable by rams 59. Upper and lower inner backup rolls 18 and 19 of smaller diameter and centered on axes 18A and 19A are provided between the rolls 3 and 4, supported on journal blocks 17 and 18 received in respective guide elements 15 and 16 vertically displaceable in the frame 1 by means of cylinders 60. Small-diameter working rolls 13 and 14 centered on respective axes 13A and 14A are provided between the inner backup rolls 19 and 30, carried in journal blocks 11 and 12 received between guide elements 9 and 10. The guide elements 9, 10, 16, and 15 are constructed with axial ridges 48 and grooves 49 (FIG. 3) to allow the respective blocks 11, 12, 17, and 18 to be displaced axially, both to comply with the width of a workpiece passing through them in a direction D perpendicular to the plane P of the axes 3A, 4A, 19A and 20A and to allow them to be switched for new or differently sized rolls.

Level with these working rolls 13 and 14, the frame 1 is formed with a pair of confronting recesses 5 constituting horizontally open extensions of the windows 2 and provided with horizontally effective positioning actuators 6 of the double-acting hydraulic type whose piston rods 38 are connected with the support 7 of a frame member or block 8. The guide elements 9 and 10 are vertically displaceable on these blocks 8 by means of actuators shown in part at 51, but are braced outwardly thereagainst, so that these actuators 6 can determine the exact position of the axes 13A and 14A relative to the plane P. The guide elements 9 and 10 facilitate axial horizontal sliding of the journal blocks 11 and 12 of the rolls 13 and 14. The guides 15 and 16 are similarly provided in the windows 2 to support the journal blocks 17 and 18 of the inner backup rolls 19 and 20. These guides 15 and 16 can be subjected to bending forces as is known.

Upper and lower traverse or bridge members 21 and 22 extend horizontally above and below the nip between the ends of the frame 1 and carry a bracing unit 44 having a body or insert 23 with upper and lower rows of cylinders 24 whose pistons 26 have piston rods 57. The outer ends of these rods 57 are formed with grooves 39 so they can fit into the ends of complementary T-section grooves 28 of respective slides 27. As seen in FIGS. 3 and 4, the outer ends of the slides 27 are formed as forks 29 whose axially oppositely directed outer faces are formed with groove or ridge guides which slide along profiled rails 30 between two forks 29. Each fork 29 journals a respective support roller 32. The inner periphery of the insert 23 is formed by a pair of pivotal flaps 31.

Figure 5:
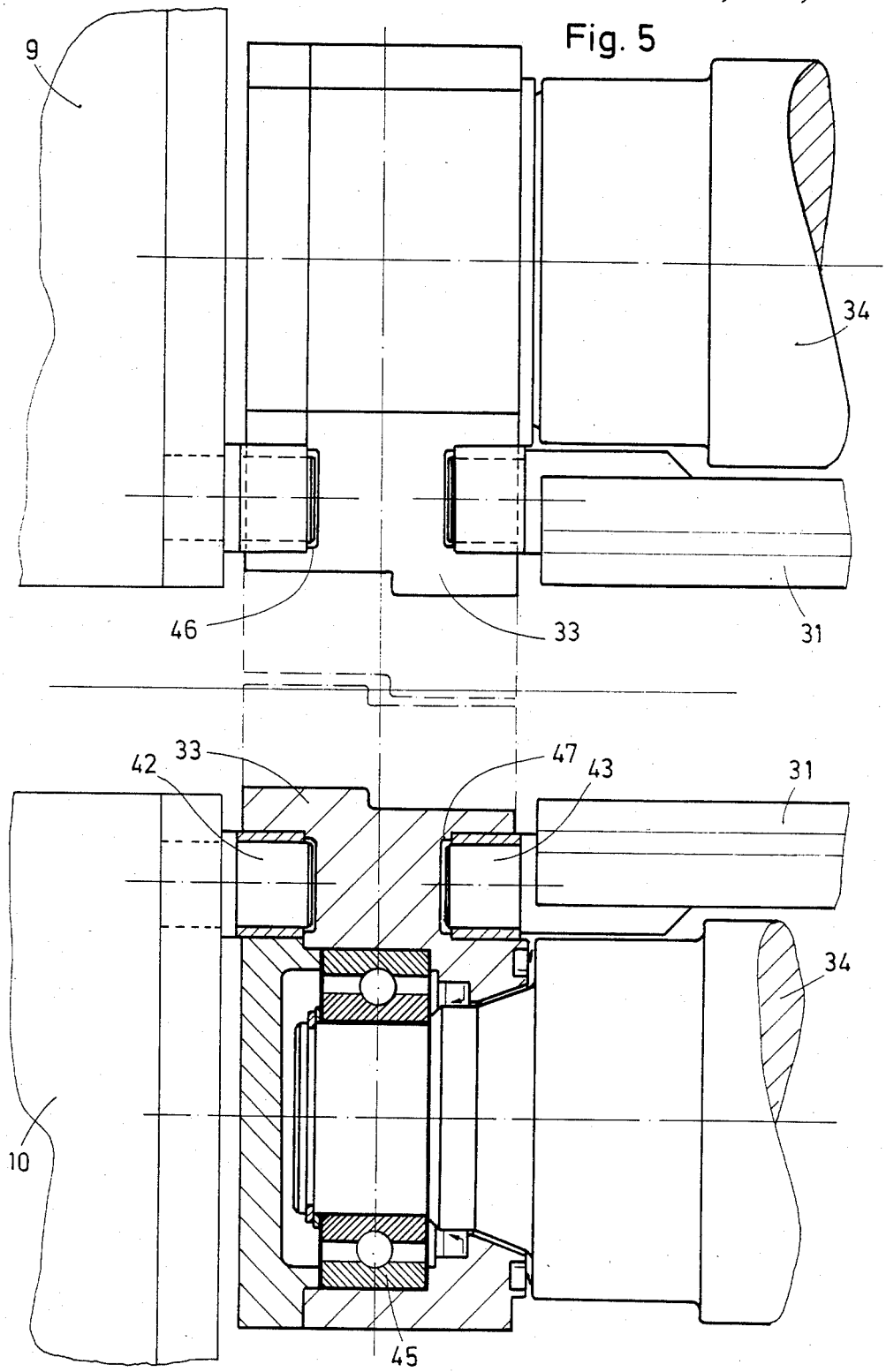
FIG. 5 is a large-scale sectional end view of a detail of the invention.

The rows of bracing cylinders 24 are each flanked by a pair of outer cylinders 25 whose piston rods are connected to slides 40 having forks 41 in which the outer ends of support or link arms 33 are journaled. The inner ends of these arms 33, that is the ends closer to the nip 62 defined between the working rolls 13 and 14, carry the bearings 45 (FIG. 5) for upper and lower bracing rolls 34 extending parallel to the cylinder row and axis and centered on axes parallel to those of all the other rolls. These rolls 34 are horizontally braced in turn between the row of rollers 32 on the outside and, diametrally opposite therefrom, against the respective working rolls 13 and 14.

The outer ends of the pivotal arms 33 are formed with axially outwardly open grooves 42 in which can slide pins 43 projecting from the respective guide elements 9 and 10, and inwardly open confronting grooves 47 in which are engaged pins 43 projecting from the flaps 31. The grooves 46 extend along such paths that the axes of the bracing rolls 34 follow the paths indicated at p in FIG. 3 as they move from the retracted position shown in FIG. 2 and FIG. 3 in solid lines to the extended position of FIG. 1 and FIG. 3 in dot-dash lines.

When the cylinders 24 and 25 have all been retracted as much as possible, all of the bracing mechanism is drawn out of axial alignment with the journal blocks 11 and 12. This allows the rollers 13 and 14 to be slid with their blocks 11 and 12 axially out of the stand and replaced by similar blocks carrying larger working rolls 35. Of course the upper backup rolls 3 and 19 have to be lifted and the lower backup rolls 4 and 20 lowered somewhat to allow this exchange to be made, and it is possible at this time to switch the inner backup rolls 19 and 20 too.

Figure 2:
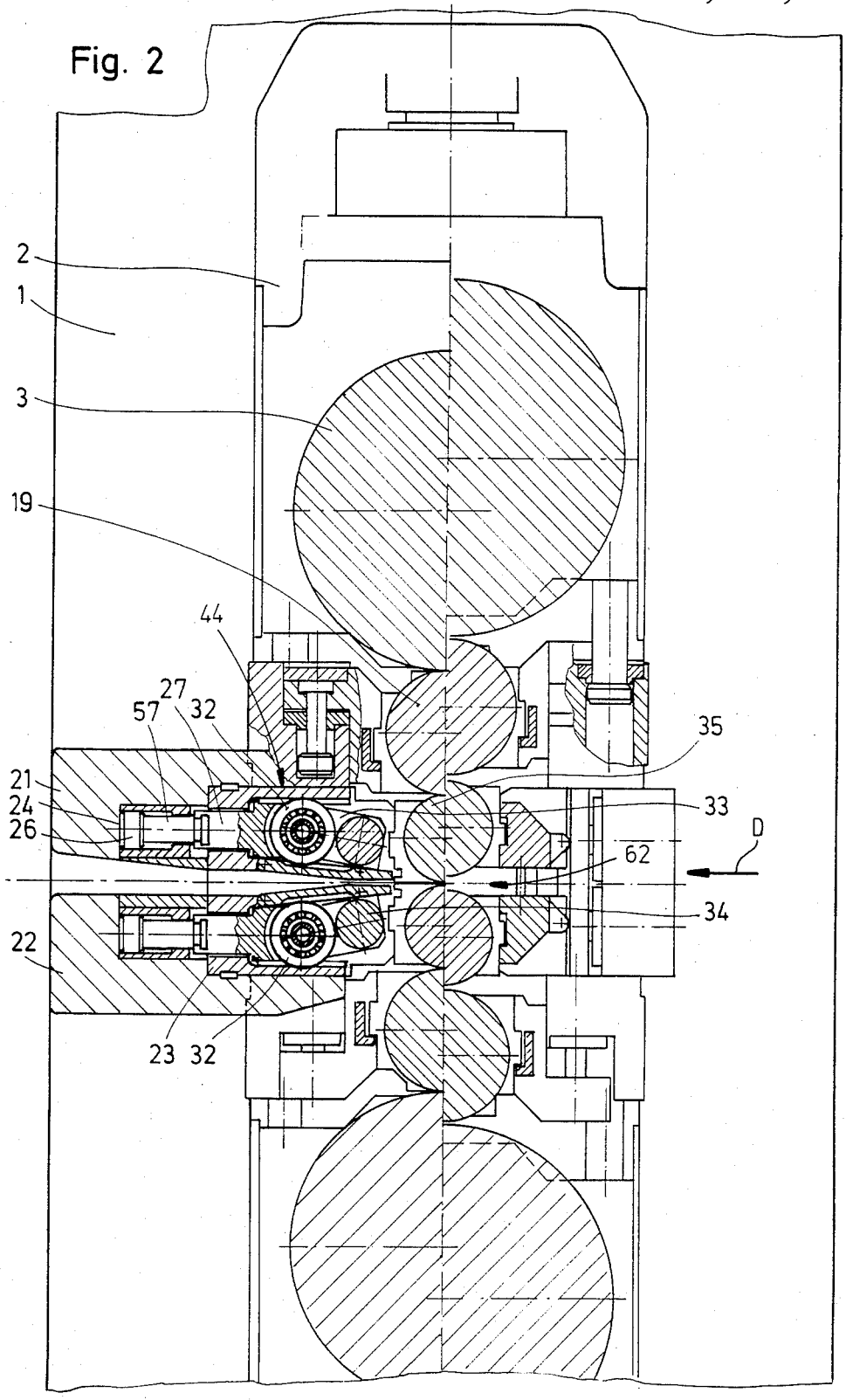
FIG. 2 is a vertical cross section like FIG. 1 but showing the bracing unit retracted and the stand equipped with larger working rolls.

If large-diameter working rolls 35 are used that do not need to be laterally braced, it is possible either to retain the bracing unit 44 in the retracted position shown in FIG. 2 and in FIG. 3 in solid lines. It is also possible to remove the entire bracing unit 44 simply by sliding it out along axial guides 37 (FIG. 3). This will remove the slides 27, rollers 32, arms 33, roll 34, and flaps 31. The grooved piston rods 57 and cylinders 24 will be left in place, along with their hydraulic connections, so such removal of the bracing unit 44 is extremely easy. The grooves 28 of the slides 27 can slide over and interfit with the grooved end 39 of the rods 57, so that the force-transmitting connection between these elements is made and unmade simply by axially sliding the unit 44 in and out.

We claim:

1. A roll stand comprising:

a frame having a pair of sides spaced apart transversely of a workpiece travel direction and formed with respective throughgoing windows aligned transversely of the direction and a pair of vertically spaced traverses extending horizontally perpendicular to the direction between the frame sides;

two outer backup rolls centered on parallel axes transverse to the direction and spaced vertically apart and each having two journal blocks vertically displaceable and guided in the windows of the respective frame sides;

respective upper and lower guide elements limitedly vertically displaceable in the windows between the outer-roll journal blocks;

two inner backup rolls centered on parallel axes between and coplanar with the outer-roll axes and each having two journal blocks vertically displaceable and guided in the respective guide elements;

respective pairs of positioning actuators in the windows vertically between the respective inner-roll blocks, the actuators of each pair confronting each other in the direction and being oppositely braced in the direction against the respective frame side;

respective supports carried on and between the actuators of each pair;

respective second upper and lower guide elements limitedly vertically displaceable on the supports, the positioning actuators being expansible and contractile to displace the guide elements in the direction;

two working rolls centered on parallel axes between and parallel to the other roll axes and each having two journal blocks fitted to and axially slidable in the respective second guide elements, whereby the positioning actuators can position the working rolls in the direction;

an insert carried in the traverses axially between and secured to the positioning actuators upstream of the roll-axis plane;

respective rows of bracing rollers carried on the insert and extending axially along the working rolls between same and the traverses, the insert, bracing rollers, and upstream positioning actuators forming an integral bracing unit, at least one of the windows being shaped such that the bracing unit can be withdrawn axially through the respective frame side; and means including respective rows of bracing actuators braced in the direction between the rollers and the traverses for displacing the rollers through at least 50 mm in the direction and pressing the rollers opposite to the direction against the respective working rolls.

2. The six-high roll stand defined in claim 1 wherein the inner backup rolls are axially displaceable with the respective journal blocks in the frame.

3. The six-high roll stand defined in claim 1 wherein the bracing actuators are carried permanently in the respective traverses and each have upstream ends, the rollers each having force-transmitting links having downstream ends complementary to the respective upstream ends and having axially extending interengaging formations that couple the bracing actuators in the direction to the respective links and that permit the links to slide axially with the insert off the bracing actuators.

4. The six-high roll stand defined in claim 3 wherein the upstream ends of the bracing actuators are circumferentially grooved and the downstream ends of the links are each formed with a complementary T-section groove open parallel to the axes.

5. The six-high roll stand defined in claim 3, further comprising:

respective pairs of outer actuators flanking the rows of bracing actuators;

respective link arms extending upstream through the insert toward the working rolls and having upstream ends; and respective force-transmitting bracing rolls rotatable about and centered on axes parallel to and downstream of the respective working rolls and journaled in the outer ends of the link arms, whereby the outer actuators, link arms, and bracing rolls form part of the bracing unit.

6. The six-high roll stand defined in claim 5 wherein the outer actuators are carried permanently in the respective traverses and each have upstream ends, the link arms having downstream ends complementary to the respective upstream ends and having axially extending interengaging formations that couple the outer actuators in the direction to the respective link arms and that permit the link arms to slide axially with the insert off the outer actuators.

7. The six-high roll stand defined in claim 5 wherein the link arms and upstream positioning actuators are formed with interengaging guides extending generally in the direction and defining the paths of movement of the respective bracing rolls.

8. The six-high roll stand defined in claim 5, further comprising a pair of workpiece guide flaps pivoted on the insert about respective axes spaced downstream from the plane and defining a workpiece passage.

9. The six-high roll stand defined in claim 8 wherein the link arms and flaps are formed with interengaging guides extending generally in the direction and defining the positions of the respective flaps.

10. The six-high roll stand defined in claim 1, further comprising drive means at one of the frame sides connected to the backup rolls for rotating same about the respective axes.

11. The six-high roll stand defined in claim 1 wherein the axes of the working rolls are downstream of the plane of outer- and inner-roll axes.

12. The six-high roll stand defined in claim 1 wherein the inner-roll journal blocks and the respective guide elements are formed with interengaging axially extending slide formations.

13. The six-high roll stand defined in claim 12 wherein the inner-roll journal blocks and their formations are symmetrical about horizontal planes and the respective inner-roll axes are offset therefrom.

* * * * *